US005334495A

United States Patent [19]

Black et al.

[11] Patent Number: 5,334,495

[45] Date of Patent: Aug. 2, 1994

[54] SILVER HALIDE GRAINS HAVING SMALL TWIN-PLANE SEPARATIONS

[75] Inventors: Donald L. Black, Webster; Robert D. Wilson, Rochester, both of N.Y.

[73] Assignee: Eastman Kodak Company, Rochester, N.Y.

[21] Appl. No.: 982,531

[22] Filed: Nov. 27, 1992

Related U.S. Application Data

[60] Division of Ser. No. 792,119, Nov. 14, 1991, Pat. No. 5,219,720, which is a continuation-in-part of Ser. No. 522,718, May 14, 1990, abandoned.

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,434,226 | 2/1984 | Wilgus et al. | 430/567 |
| 4,672,027 | 6/1987 | Daubendiek et al. | 430/567 |
| 4,693,964 | 9/1987 | Daubendiek et al. | 430/567 |
| 4,797,354 | 1/1989 | Saitou et al. | 430/567 |
| 4,853,322 | 8/1989 | Makino et al. | 430/567 |
| 4,914,014 | 4/1990 | Daubendiek et al. | 430/567 |
| 4,945,037 | 7/1990 | Saitou | 430/567 |

FOREIGN PATENT DOCUMENTS

| | | |
|---|---|---|
| 0273411 | 12/1987 | European Pat. Off. . |
| 0347850 | 6/1989 | European Pat. Off. . |
| 0359506 | 3/1990 | European Pat. Off. . |

OTHER PUBLICATIONS

Cohen et al. "Gelatin Charges and Their Effect on the Growth of Silver Bromide", 1975, pp. 198–217.

Research Disclosure #29945, "Nucleation of Tabular Grain Emulsions at High pBr", Mar. 1989, pp. 185–197.

Joe E. Maskasky, Journal of Imaging Science, May 1987, vol. 31, No. 3, pp. 93–99.

*Primary Examiner*—Janet C. Baxter

*Attorney, Agent, or Firm*—Paul A. Leipold

[57] ABSTRACT

The invention is generally accomplished by providing a tabular-grain silver halide emulsion in which at least 50 percent of the total grain projected area is accounted for by tabular grains having a mean diameter of at least 0.6 micrometer and a spacing between at least two parallel twin planes of less than about 0.011 micrometer. In a preferred form, at least 90 percent of the total grain projected area is accounted for by the tabular grains of the invention having a mean diameter of at least 0.6 micrometer and a spacing between at least two parallel twin planes of less than 0.012 micrometer.

20 Claims, 6 Drawing Sheets

SILVER HALIDE GRAINS HAVING SMALL TWIN-PLANE SEPARATIONS

CROSS-REFERENCE TO RELATED APPLICATIONS

This is a divisional of application Ser. No. 792,119, filed Nov. 14, 1991, now U.S. Pat. No. 5,219720, which is a continuation-in-part of our earlier filed application U.S. Ser. No. 522,718 filed on May 14, 1990, now abandoned.

FIELD OF THE INVENTION

This invention relates to silver halide grains having small spacing between twin-plane separations. In particular, it relates to silver halide emulsions containing such grains and methods of their formation.

PRIOR ART

U.S. Pat. No. 4,439,520—Kofron et al, and U.S. Pat. No. 4,433,048—Solberg et al disclose that high aspect ratio silver halide emulsions provide improvements in photographic materials over those having low aspect ratios. These materials when chemically sensitized have been shown to provide improved products with improved sharpness and grain. U.S. Pat. No. 4,672,027—Daubendiek et al and U.S. Pat. No. 4,693,964—Daubendiek et al disclose that silver halide grains of a high aspect ratio but very small mean diameter may be formed with enhancement of speed granularity relationships. The materials of Daubendiek et al are very thin.

European Patent Application 0,273,411—Makino et al discloses silver halide emulsions in which the grains have a mean aspect ratio of not more than 8.0 and a diameter of at least 0.15 μm. The emulsion materials of Makino et al further form tabular grains in which the ratio of the thickness (b) of the tabular grain to the longest spacing (a) between two or more parallel twinning planes of the tabular grain is at least 5.

The silver halide grains and emulsions as disclosed in the above publications produce satisfactory images. Nevertheless, there is a continuing need for improved photographic materials having higher sensitivity and/or improved granularity.

THE INVENTION

An object of the invention is to provide improved photographic elements.

Another object of the invention is to provide silver halide grains having an improved sensitivity/-granularity relationship.

These and other objects of the invention are generally accomplished by providing a tabular-grain silver halide emulsion in which at least 50 percent of the total grain projected area is accounted for by tabular grains of the invention having a mean diameter of at least 0.6 micrometer and a spacing between at least two parallel twin planes of less than about 0.012 micrometer. In a preferred form, at least 90 percent of the total grain projected area is accounted for by the tabular grains of the invention having a mean diameter of at least 0.6 micrometer and a mean spacing between at least two parallel twin planes of less than about 0.012 micrometer. In a further preferred form of the invention, at least 50% of the number of silver halide grains in the emulsion are the grains of the invention. The grains of the invention provide an increase in speed without an increase in granularity as the grains of the invention are of higher speed than previous silver halide grains of the same size.

MODES OF PRACTICING THE INVENTION

Figure 1:
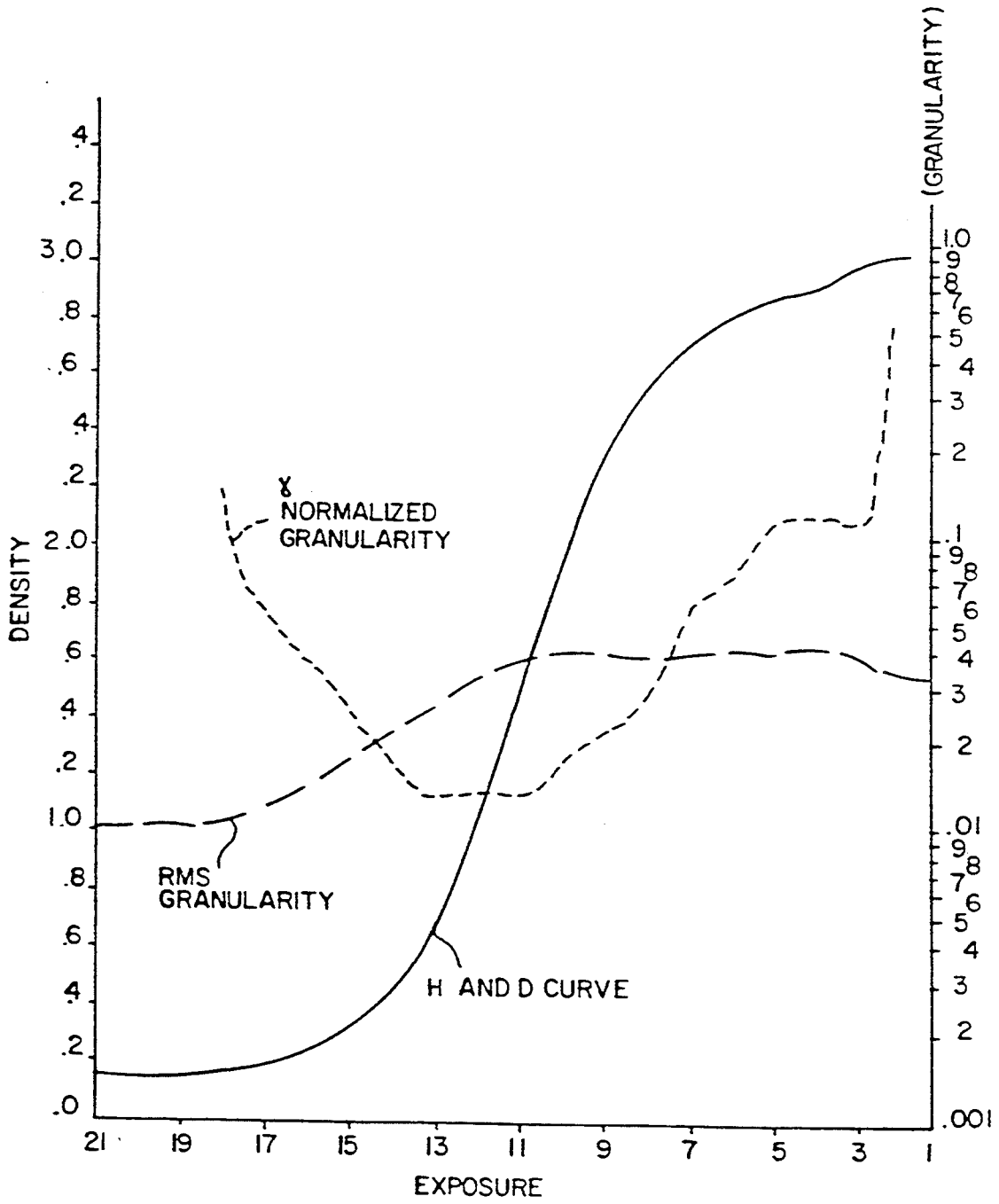
FIGS. 1 and 2 illustrate the sensitometric responses of coatings containing the green sensitized emulsions of Examples 1 and 2.

The invention has advantages over prior practices in that, while it was known that the growth in tabular grains involved a parallel twin-plane mechanism, it was not known that, by control of the twin-plane separation, the photographic performance of the emulsion containing the grain could be controlled and improved. The grains of the invention, having the same equivalent diameter and thickness as prior-art grains, exhibit higher sensitivity and lower granularity as a result of decreasing the separation between the parallel twin planes to less than that of the prior art grains. The grains of the invention surprisingly provide an increase in speed of films formed of a particular grain projected size without also causing an increase in granularity.

The tabular grains of the invention forming greater than at least 50 percent of the total grain projected area of the emulsions of the invention have a diameter of at least 0.6 micrometer. Suitable grain size has been found to be up to about 10 microns. A preferred grain size has been found to be a diameter of between about 0.6 and 5 micrometer because of speed granularity advantage. The suitable thickness of the grains of at least 0.6 micrometer diameter has been found to be between 0.05 and 0.5 micrometer. It is preferred that the grains have a thickness of greater than 0.11 micrometer for good pressure sensitivity performance. The parallel twin plane necessary for the growth of tabular grains can be directly observed using cross-sectioning techniques at cryogenic temperatures to provide samples with the correct crystallographic orientation and thickness for study by electron microscopy. These temperatures are necessary to change the physical properties of the gelatin and silver halide grains to obtain the thin sections necessary for accurate measurements. A preferred tabular-grain emulsion according to the invention has at least 50 percent of the total grain projected area accounted for by tabular grains having a mean diameter in the range of from 1.0 to 10.0 micrometer.

In preferred forms of the invention, it is found that the number of the thin twin-plane separation grains of the invention in the emulsion is suitably greater than 50% of the total number of silver halide grains present. It is preferred that the number of narrow twin-plane separation grains be greater than 70% and most preferably greater than 90% of the total number of silver halide grains present for the best granularity improvement. It is preferred because having a larger number of grains in accordance with the invention provides an advantage in speed/granularity relationship over an emulsion in which only a small percentage of the grains have the narrow twin-plane separation of the invention, and the remainder of the emulsion was comprised of many very small or non-tabular grains.

Cross sections for measuring grains of the invention are prepared by mounting a sample of a silver halide emulsion coated in a gelatin matrix on a film support in a cryo-ultramicrotome. The sample, knife, and chamber are cooled to approximately −100° C. A cross section less than 0.05 microns thick is cut from the sample by a diamond knife. It is observed in a transmission electron microscope and recorded on an electron micrograph from which the twin plane separation is measured directly. For these studies the twin plane separations from at least 100 grains were measured to obtain the average values.

An average parallel twin plane spacing in the tabular grain of the invention of up to 0.012 micrometer has been found to be suitable for the invention. To achieve the advantages of the invention, a parallel twin-plane separation of 0.011 micrometer or less than 0.011 micrometer is preferred. A preferred range of spacing between the twin planes has been found to be between less than 0.011 and about 0.005 micrometers for highest sensitivity and lowest granularity.

The narrow twin-plane grains of the invention may be present in any amount comprising at least 50 percent of the total grain projected area. A projected area of at least 70 percent of the total grain projected area has been found to be particularly suitable. A preferred amount has been found to be at least 90 percent of the total projected area of the grains of the emulsion accounted for by tabular grains having a mean diameter of at least 0.6 micrometer and a spacing between at least two parallel twin planes of less than 0.012 micrometer. In a preferred form, at least 50 percent of the total grain projected area is accounted for by tabular grains satisfying the relationship $ECD/t^2$ greater than 25 where ECD is the mean effective circular diameter in micrometers of the tabular grains and t is the mean thickness in micrometers of the tabular grains.

A preferred tabular-grain emulsion according to the invention is one in which greater than 50 percent of the total grain projected area is accounted for by tabular grains satisfying the relationship:

$$ECD/t^2>40$$

where

ECD is the mean effective circular diameter in micrometer of the tabular grains and t is the mean thickness in micrometer of the tabular grains.

The method of forming the grains of the invention may be any method resulting in the emulsion of the invention. Typically, the method of formation is by a twin-jet process.

A preferred tabular-grain emulsion according to the invention is one in which iodide accounts for less than 40 mole percent of the total halide forming said tabular grains. A preferred tabular-grain emulsion according to the invention is one in which iodide accounts for 0.1 to 25 mole percent of the total halide forming said tabular grains. A preferred tabular-grain emulsion according to this invention is one in which iodide accounts for from 1 to 15 mole percent of the total halide forming said tabular grains. A preferred tabular-grain emulsion according to the invention is one in which said tabular grains forming greater than 50 percent of the total grain projected area are bounded by parallel major faces lying in (111) crystallographic planes.

As is known the formation of tabular silver halide grains is generally carried out in three stages; nucleation, ripening, and growth. The twin-plane separation distance of the grains formed by the method of this invention is determined during nucleation. It has been discovered that by control of the nucleation conditions, a high number percentage of the invention grains may be produced in emulsions. There is a high number of invention grains present as a percentage of the total number of grains in the emulsion. The grains of the present invention also provide a high percentage of the projected area of the emulsion. The nucleation conditions of the invention have been found to be best performed utilizing oxidized gel that has been found to give better results in the low bromide concentration precipitations utilized in the invention. The dual jet method of combination of the halide and bromide has also been found to be preferred for better control of concentrations at the point of nucleation and, therefore, more uniform nucleation. The preferred pBr during nucleation has been found to be between 2.1 and about 3. If the pBr is too low, the small nucleii necessary for the invention are not formed in large quantities. If the pBr is too high indicating a low concentration of bromide, an emulsion is formed that has a high proportion of non-twin-plane grains. It has been found to be preferred that the pH during nucleation be between about 1.5 and about 3 in order to increase the propensity for twinning at the pBr range utilized. The preferred temperature during nucleation is between about 35° and about 70° C. Subsequent to nucleation in the growth of tabular grains of the invention a shift in the growth environment from a pBr at the beginning of growth of between about 1.4 and about 1.9 to a pBr of between about 3.0 and about 3.6 pBr can be used to control overall thickness. The change takes place after between about 25 and about 80 percent of the total silver is added.

Vehicles for the emulsions of the invention, including both binders and peptizers, can be selected from those conventionally employed in photographic silver halide emulsions. Preferred peptizers are hydrophilic colloids which can be used alone or in combination with hydrophobic materials. Useful hydrophilic materials include both naturally occurring substances such as proteins, protein derivatives, cellulose derivatives such as cellulose esters, gelatin such as alkali-treated gelatin or acid-treated gelatin, gelatin derivatives such as acetylated gelatin and phthalated gelatin, polysaccharides such as dextran, gum arabic, zein, casein, pectin, collagen derivatives, agar-agar, arrowroot and albumin and other vehicles and binders known in the photographic art. Oxidized gelatin is highly preferred for nucleation.

The silver halide emulsions are preferably washed to remove soluble salts. Any of the processes and compositions known in the photographic art for this purpose are useful for washing the silver halide emulsions of the invention. The soluble salts can be removed by decantation, filtration, and/or chill setting and leaching and coagulation washing, by centrifugation, and by other methods and means known in the photographic art.

The photographic silver halide can be chemically sensitized by procedures and with compounds known in the photographic art. For example, the silver halide can be chemically sensitized with active gelatin or with sulfur, selenium, tellurium, gold, platinum, iridium, indium, palladium, osmium, rhodium, rhenium or phosphorous sensitizers or combinations of these sensitizers, such as at pAg levels within the range of 5 to 10 and at pH levels within the range of 5 to 8 at temperatures within the range of 30° to 80° C. The silver halide can be chemically sensitized in the presence of antifoggants, also known as chemical finish modifiers, such as compounds known to suppress fog and increase speed during chemical sensitization, such as azaindenes, azapyridazines, azapyrimidines, benzothiazolium salts, and sensitizers having one or more heterocyclic nuclei. Optionally, the silver halide can be reduction-sensitized such as with hydrogen or through the use of other reducing agents such as stannous chloride, thiourea dioxide, polyamines or amineboranes. The photographic silver halide emulsion can be spectrally sensitized by, for example, dyes of a variety of classes, including the polymethine-dye class, including cyanines, merocyanines, complex cyanines and merocyanines, oxonols, hemioxonols, styryls, merostyryls, and streptocyanines. Combinations of spectral sensitizers are also useful.

The photographic silver halide elements can be either single-color (monochrome) or multicolor elements. In a multicolor element, a cyan dye-forming coupler is typically associated with a red-sensitive emulsion, a magenta dye-forming coupler is typically associated with a green-sensitive emulsion, and a yellow dye-forming coupler is associated with a blue-sensitive emulsion. Multicolor elements typically contain dye-forming units sensitive to each of the three primary regions of the spectrum. Each unit can comprise a single emulsion layer or multiple emulsion layers. The layers of the element and the image-forming units can be arranged in various orders as known in the photographic art. Color photographic materials are preferred for use of the emulsions of this invention.

A photograhic element of the invention comprises a film support and, coated on the support, a tabular-grain silver bromoiodide emulsion in which at least 50 percent of the total grain projected area is accounted for by tabular silver bromoiodide grains containing less than 10 mole percent iodide, based on total halide, having a mean diameter of at least 0.6 micrometer and exhibiting a spacing between at least two parallel twin planes of less than about 0.011 micrometer. A photographic element of the invention is a film wherein the speed of said film is greater than that of a film with equal mean diameter tabular grains of greater twin plane separation.

A radiographic element of the invention comprises a transparent film support having opposed major faces and, coated on the support, a tabular-grain silver bromoiodide emulsion in which at least 50 percent of the total grain projected area is accounted for by tabular silver bromide grains containing less than 5 mole percent iodide, based on total halide, having a mean diameter of at least 0.6 micrometer and exhibiting a spacing between at least two parallel twin planes of less than about 0.011 micrometer. A preferred radiographic element according to the invention is one in which the tabular-grain emulsion coated on both major faces of the transparent film support.

A color photographic element of the invention comprises a film support and, coated on said film support, at least one color-forming layer unit comprised of an image-forming dye or a precursor thereof and a tabular-grain silver bromoiodide emulsion in which at least 50 percent of the total grain projected area is accounted for by tabular silver bromoiodide grains containing from 2 to 25 mole percent iodide, based on total halide, having a mean diameter of at least 0.6 micrometer and exhibiting a spacing between at least two parallel twin planes of less than about 0.011 micrometer.

The photographic element can contain added layers such as filter layers, interlayers, overcoat layers, subbing layers, and other layers known in the art.

In the following discussion of illustrative materials useful in elements of the invention, reference will be made to *Research Disclosure,* December, 1978, Item 17643, published by Kenneth Mason Publications, Ltd., Dudly Annex, 21a North Street, Emsworth, Hampshire P010 7DQ, England, the disclosures of which are incorporated by reference. The publication will be identified hereafter by the term "*Research Disclosure*".

Any coupler or combination of couplers known in the photographic art can be used with the silver halide emulsions as described to form color-producing photographic elements. Examples of useful couplers are described in, for example, *Research Disclosure* Section VII, paragraphs D, E, F, and G and in U.S. Pat. No. 4,433,048 and the publications cited therein. The couplers can be incorporated as described in *Research Disclosure* Section VII and the publications cited therein.

The photographic emulsions and elements can contain addenda known to be useful in the photographic art. The photographic emulsions and elements can contain brighteners (*Research Disclosure* Section V), antifoggants and stabilizers (*Research Disclosure* Section VI), antistain agents and image-dye stabilizers (*Research Disclosure* Section VII, paragraphs I and J), light-absorbing and -scattering materials (*Research Disclosure* Section VIII) hardeners (*Research Disclosure* Section XI), plasticizers and lubricants (*Research Disclosure* Section XII), antistatic agents (*Research Disclosure* Section XIII), matting agents (*Research Disclosure* Section XVI), and development modifiers (*Research Disclosure* Section XXI).

The photographic elements can be coated on a variety of supports such as film and paper base, as described in *Research Disclosure* Section XVII and the references described therein.

The photographic elements can be exposed to actinic radiation, typically in the visible region of the spectrum, to form a latent image as described in *Research Disclosure* Section XVIII and then processed to form a visible image using processes and compositions known in the art, such as described in *Research Disclosure* Section XIX and U.S. Pat. No. 4,433,048 and the references described therein.

Processing of a color photographic element as described to form a visible dye image includes the step of contacting the element with a color photographic silver halide developing agent to reduce developable silver halide and oxidize the color-developing agent. The oxidized color-developing agent in turn reacts with at least one coupler to yield a dye.

Preferred color-developing agents are p-phenylenediamines. Especially preferred are 4-amino-3-methyl-N,N-diethylaniline hydrochloride, 4-amino-3-methyl-N-ethyl-N-$\beta$-(methanesulfonamido)-ethylaniline sulfate hydrate, 4-amino-3-methyl-N-ethyl-N-$\beta$-hydroxyethylaniline sulfate, 4-amino-3-$\beta$-(methanesulfonamido)-ethyl-N,N-diethylaniline hydrochloride, and 4-amino-N-ethyl-N-(2-methoxyethyl)-m-toluidine di-p-toluene sulfonic acid.

With negative-working silver halide emulsions, this processing step leads to a negative image. To obtain a positive (or reversal) image, this step can be preceded by development with a nonchromogenic developing agent to develop exposed silver halide but not form dye, and then uniform fogging of the element to render unexposed silver halide developable. The silver halide emulsions of this invention are preferably employed in photographic elements designed to be processed to form a color negative image.

It is also contemplated that the doping of the invention may take place during the growth stage of the silver halide grains. In the formation process of silver halide grains or in the physical ripening process of emulsions, cadmium salts, zinc salts, selenium salts, lead salts, thallium salts, rhodium salts or its complex salts, ion or its complex salts, or the like may be present for various purposes such as, for example, to achieve hard toning, sensitization, desensitization and internal latent-image formation.

The following Examples are intended to be illustrative of the invention. Parts are by weight and pBr is at 60° C. unless otherwise indicated.

EXAMPLES

Example 1

This example illustrates the preparation of a tabular emulsion with a small twin-plane separation (0.011 microns) according to the present invention. It yields a tabular silver halide grain emulsion of equivalent circular diameter 0.74 micrometers (as measured by sizing scanning electron microscope photos on a SUMMA graphics tablet) and a thickness of 0.116 micrometers. About 83 percent of the total number of the grains in the emulsion are tabular. The halide composition is 96.7% BR- and 3.3% I- (as found by neutron activation analysis) and this is nominally distributed uniformly throughout the grain. The basic precipitation sequence is one of (i) nucleation at a high molar addition rate, low pH, high pBr (2.18), low temperature, and using an oxidized gelatin at a low level. This is followed by (ii) a transition to a higher temperature, higher pH, higher Br-concentration, and higher oxidized gelatin level (without additional $AgNO_3$ flow). Next follows the (iii) growth stage in which a AgI source of I- is added (at 0.03 molar ratio of the $AgNO_3$ stream) in a triple jet addition with an aqueous solution of NaBr and a solution of $AgNO_3$, and in such a way that the pBr of the reaction vessel is controlled. This procedure is similar to one described in U.S. Pat. No. 4,672,027—Daubendiek et al, but is modified here to incorporate a shift in pBr during the growth stage (to about 3.3 pBr). A tabular grain of conventional thickness but with atypically narrow separation between the double parallel twin-planes can be obtained. A specific set of precipitation parameters for Example 1 is given below.

Aqueous solutions of 8 mL of 1.25M $AgNO_3$ and 8 mL of 1.25M NaBr.99I.01 are added together at 80 mL/min into a vessel containing 3 liters of solution at 35° C. which consists of 7.5 g $H_2O_2$-oxidized gelatin, approximately 45 mL of 2N $H_2SO_4$ to adjust the solution pH to 1.8, 0.02 moles NaBr, and 0.7 mL of antifoamant (Nalco 2341), plus distilled water to bring the total volume to 3000 mL. For the next 21 minutes no additional $AgNO_3$ is added to the vessel, but temperature, gel concentration, pH, and pBr are all adjusted. This includes a 15-minute period during which the temperature is raised from 35° C. to 60° C. at 5° C./3 min., and a subsequent hold at 60° C. for 3 minutes, then addition of more oxidized gelatin (100 g in 500 mL D.W. at 60° C.) followed by a pH upward adjustment to 6.0, and adjustment of the pBr to 1.9 with 4M NaBr. Subsequent to this transition step, growth is carried out by double-jet addition of a total of 2.96 liters of 1.2M $AgNO_3$ and 1.2M NaBr, but with a 3rd jet (coupled to the $AgNO_3$ delivery rate) running in a dilute (0.36M) emulsion of AgI (ca 0.1 μm esd grains) for an overall 3 m % I- final grain composition. This growth stage is performed at 60° C. and with the pBr maintained at 1.9 until 30% of the total molar amount of Ag (from all sources) has been added. At that point the pBr is shifted up to 3.3 (by temporarily terminating the halide solution delivery) and the remainder of the growth occurs under those conditions. For this growth stage the reactant addition rates are not constant but are linearly increased from 16.5 mL/min to 19.5 mL/min over the first 60 minutes and then are kept at that 19.5 mL/min for the remainder of the precipitation. The final emulsion is washed by ultra-filtration.

Sensitization results of this emulsion will follow the description of the comparison tabular grain emulsion.

Example 2 (Control)

This example illustrates the preparation of a conventional emulsion of the same outward dimensions and iodide composition as that formed in Example 1, but one which will have a larger average twin-plane separation (0.015 microns). The procedure below yields comparably sized grains to Example 1. The number weighted equivalent circular diameter is 0.77 micrometers (via SEM/SUMMA sizing), and the thickness as estimated by an interference reflectance technique is 0.106 micrometers. The measured I-composition is matched (97.1% Br- and 2.9% I- as determined by NAA). This precipitation is an iso-thermal one which employs non-oxidized gelatin and an additional gelatin solution dump (in which the dilution effect also results in a small upward pBr shift). The growth is via double-jet addition of $AgNO_3$ and mixed halide (97 mol % NaBr and 3 mol % KI) aqueous solutions with pBr controlled at 1.7 during most of the precipitation and then a shift to high pBr (3.3 pBr) at a specified point in the final portion of the growth stage. The specific precipitation parameters follow.

Aqueous solutions of 70 mL of 2.5M $AgNO_3$ and 70 mL of 2.5M NaBr are added together at 35 mL/min into a vessel containing 4 liters of solution at 65° C. which consists of 12.0 g of non-oxidized non-deionized lime-processed bone gelatin, 0.272 moles NaBr, and 0.7 mL of antifoamant (Nalco 2341), plus D.W. to bring the total volume to 4000 mL. The pH is 5.84 and the pBr is 1.4 (at 65° C.) during this nucleation. There follows a 2-minute cessation of the silver nitrate and salt flows, during which a 5-liter aqueous solution containing 140 g additional gelatin and pre-heated to 65° C. is added at once to the reaction vessel. This results in a pBr of 1.7, and this is maintained as growth is carried out by addition of 2.5M NaBr $_{0.97}I_{0.03}$ and 2.5M $AgNO_3$ at a linearly increasing flow rate of 8 mL/min to 82 mL/min over 53.5 minutes. At the end of this segment, which corresponds to 60% of the total silver involved in the precipitation the pBr is shifted up to 3.3 (by temporarily terminating the halide solution delivery) and the remainder of the growth occurs under these conditions using a constant reactant flow rate of 40 mL/minute. The emulsion is washed using ultra-filtration then finally adjusted to 3.4 pBr at 40° C.

Sensitization and Sensitometric Comparison of Emulsions of Examples 1 and 2

The two emulsions of Examples 1 and 2 above were each submitted to the same sensitization involving a green sensitive dye-set of the benzoxazole cyanine dye classes (structures shown below).

I

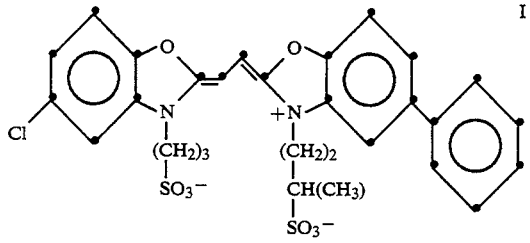

II

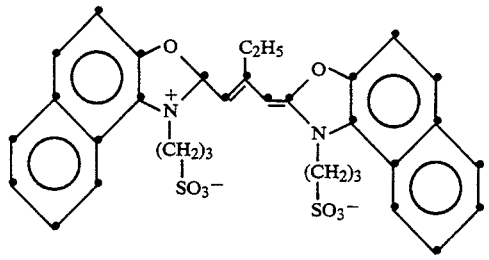

The coupler A utilized in the examples below has the following structure:

(A)

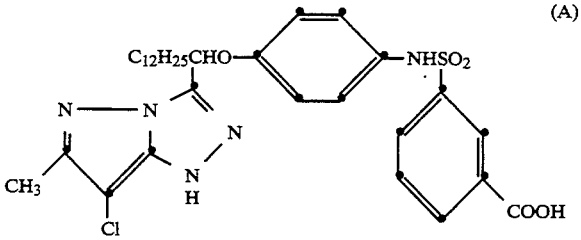

Equivalent finish positions were chosen based on the fact that the emulsions were of matched average diameter and thickness and hence are nominally equal in molar surface area. Specifically, the following sensitizer reagent levels were used (on a Ag mole basis):

(i) 250 mg NaSCN
(ii) 0.75 millimole DYE I
(iii) 0.25 millimole DYE II (with both dyes added at 1.4 pBr)
(iv) adjust pBr to 3.1
(v) 10 mg $Na_2S_2O_3$"$5H_2O$
(vi) 5.6 mg $KAuCl_4$
(vii) digest 5 min at 65° C.

The sensitized emulsions were coated in a color format at 25 mg/ft$^2$ silver, with 60 mg/ft$^2$ of a magenta dye forming coupler A, 2.0 g/Ag mol of 5-methyl-s-triazole-[2-3-a]-pyrimidine-7-ol-(Na salt), and 200 mg/ft$^2$, on a acetate film support having antihalation protection. The coatings also contained an overlying 150 mg/ft$^2$ gelatin layer.

Figure 2:
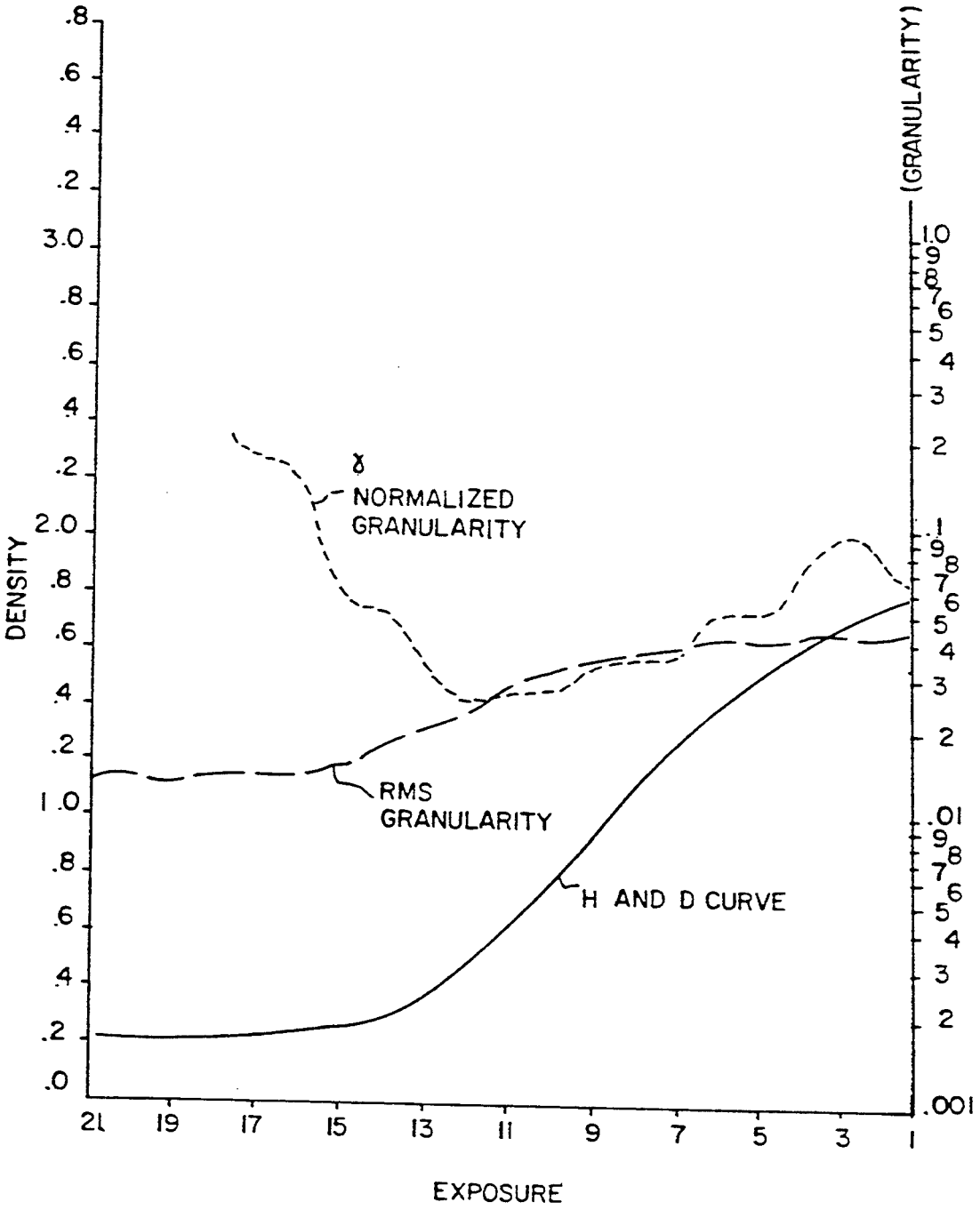

The sensitometric responses of a coating containing the green sensitized emulsion of Example 1 and the equivalent coating of the sensitized emulsion of Example 2, are shown in FIGS. 1 and 2 respectively. A 1/50 sec exposure through a Wratten-9 spectral filter was used along with development of 3.5 minutes in the C-41 color process.

The photographic advantage of the invention emulsion of Example 1 relative to the dimensionally and halide-compositionally matched tabular emulsion of Example 2 is clearly apparent with delta speed of +0.09 LogE and an improved granularity position of −12 grain units difference in the minimum of the gamma normalized granularity curves. In order to obtain gamma normalized granularity curves, the image densities at the various levels of exposure were measured, and the gamma ($\gamma$), calculated. Granularity ($\sigma$) measurements were made according to procedures described in the SPSE Handbook of Photographic Science and Engineering, edited by W. Thomas, Jr., 1973, pp. 934–939. The measurements at step 6 (midscale) were then normalized by dividing by the incremental gamma ($\gamma$) and multiplying by 1000 to obtain gamma normalized granularity ($\sigma/\gamma$). Reference may be made to EP 0 347 850, p. 36, hereby incorporated by reference, for more detail regarding granularity measurement. The $\gamma$ normalized granularity is obtained by dividing the RMS Granularity by the slope of the H and D curve.

One of the rationales for this improved sensitometry may be a lower competition for internal latent image formation (relative to surface image formation) for the emulsion in which the twin plane separation is narrower and hence further removed from the surface. A test of the potential difference in relative amounts of surface image (detectable in a non-solvent developer) to internal image (as revealed by the solvent developer KRX & KI does indeed show a lower internal response for the Example 1 material.

Example 3

This example is a further illustration of the invention and similar to the Example 1. However, changes were made to further enhance the narrowness of the twin-plane separation. The measured mean separation value found by the cryo-ultramicrotomy technique is 0.007 micrometers for the grains generated from the procedure described below. The grains produced in this example are 0.61 micrometers in number-weighted equivalent circular diameter and 0.096 micrometers in overall thickness, both as found by sizing scanning electron micrographs (SEM) on a SUMMA sizing tablet. About 65 percent of the total number of the grains in the emulsion are tabular. The iodide composition is nominally 3 mole %-I (except for the small, ca. 1%, nucleation portion which is 6 mole %-I) and it is uniformly distributed. The principal points of difference relative to Example 1 are (i) the employment of a constant 60° C. temperature instead of the low temperature nucleation of Example 1, (ii) a larger volume solution present at nucleation, and (iii) unmatched molar amounts of $AgNO_3$ and halide introduced at nucleation. A further change was the requirement of the removal of a certain fraction of the vessel contents during growth simply due to vessel capacity constraints. The specific details are provided in the paragraph below.

Aqueous solutions of 7.0 mL of 1.80M $AgNO_3$ and 7.0 mL of 2.57M NaBr $0.94I_{0.06}$ are added together at 100 mL/min into an 18 liter vessel containing 12.5 liters of solution at 60° C. which consists of 40.0 g $H_2O_2$-oxidized gelatin, 147 mL of 2N $H_2SO_4$ (pH=i1.8), 0.045 moles NaBr, and 0.7 mL Nalco 2341 antifoamant, plus enough distilled water to bring the total volume to 12,500 mL. For the next 12 minutes no silver nitrate reactant solution is added. During this time there is adjustment of gel concentration, pH and pBr. First 100 g additional oxidized gelatin 0.5 liters of D.W. at 60° C. is introduced, followed by an upward pH adjustment to 5.85, and reduction of the pBr to 1.7 with 1M NaBr. Subsequent to this transition step, growth is carried out by double-jet addition of 2.30N $AgNO_3$ and also 2.4N NaBr, with a 3rd jet (coupled to the $AgNO_3$ delivery rate) injecting a dilute (0.067M) emulsion of AgI (ca 0.1 mm esd grains) for an overall 3m % I- composition. This growth stage is performed at 60° C. and with the pBr maintained at 1.7 until 468 mL of the $AgNO_3$ solution has been added, after which the halide delivery is interrupted in such a way that the pBr is shifted up to 3.3, and the remainder of the growth is carried out with pBr maintained at this value until the 2.61 liters of 2.3M $AgNO_3$ solution initially present is consumed. However simply due to the 18 liter constraints of the reaction vessel, at a specific point 300 seconds after the start of the 3.3 pBr shift process, 2.5 liters of the vessel contents were quickly removed (without interruption of reactant solution delivery). The final emulsion is washed by ultrafiltration and then adjusted to pBr of 3.4 at 40° C.

Sensitization and photographic response of this emulsion will follow the description of the comparison-pair tabular grain emulsion (i.e. Example 4).

Example 4 (Control)

This example describes the preparation of a tabular silver halide emulsion that displays the same external thickness and diameter values as those of Example 3 but with a more conventional larger parallel twin-plane separation (measured at a mean value of 0.012 micrometers). The grain size of the ca 3 mole %-I silver bromoiodide emulsion generated in the precipitation detailed below averages 0.68 micrometers in number-weighted equivalent circular diameter and 0.099 micrometers in overall thickness based on measurements of the electron micrographs. A secondary thickness estimate by an interference reflectance technique agrees well at 0.095 micrometers. This emulsion preparation retains generally the same nucleation scheme as used in Example 2. Like Example 2, this precipitation is isothermal, involves a shift to high pBr at a specified point in the final portion of the growth stage, and utilizes non-oxidized gelatin. The details of the precipitation follows.

Aqueous solutions of 70 mL of 2.5M $AgNO_3$ and 70 mL of 2.5M NaBr are introduced at the same time at a rate of 35 mL/min into a vessel charged with 4 liters of a solution at 65° C. consisting of 12.0 g of non-oxidized non-deionized lime-processed bone gelatin, 0.272 moles NaBr, and 0.7 mL of an antifoamant (Nalco 2341), plus enough distilled water to bring the total volume to 4000 mL. The silver nitrate and halide deliveries are interrupted for 2 minutes during which time a 65° C. preheated 5 liter aqueous solution containing 140 g additional gelatin is added. This results in a pBr of 1.7 which is maintained as growth is carried out by double jet addition of 2.5M NaBr 0.97I0.03 and 2.5M $AgNO_3$. After 1.2 liters of this $AgNO_3$ reactant solution has been added at a linearly increasing flow rate of 8 mL/min to 58 mL/min over 36.3 minutes, a shift to 3.3 pBr is initiated by temporarily terminating the salt delivery. This high pBr shift position represents a point where 51% of the total 6.1 moles of Ag involved in the precipitation has been introduced. The remainder of the growth occurs with pBr maintained at 3.3 and a constant reactant flow rate of 58 mL/minute. The resulting emulsion is washed via ultrafiltration and then finally adjusted to 3.4 pBr at 40° C.

Sensitization and Sensitometric Comparison of Emulsions of Examples 3 and 4

The pair of emulsions of Examples 3 and 4 whose outward dimensions were acceptably matched, were submitted to the identical finish conditions for a sensitization to green light. These are given below and are on a Ag mole basis.

(i) 250 mg NaSCN
(ii) 0.75 millimole DYE I
(iii) 0.25 millimole DYE II (both dyes added at 1.4 pBr)
(iv) adjust pBr to 3.1
(v) 13 mg $Na_2S_2O_3$''$5H_2O$
(vi) 6.5 mg $KAuCl_4$
(vii) digest 5 minutes at 65° C.

The sensitized emulsions were coated in the same format as employed previously for Examples 1 and 2 involving 60 mg/ft$^2$ of a magenta dye forming coupler and 25 mg/ft$^2$ of silver.

Figure 3:
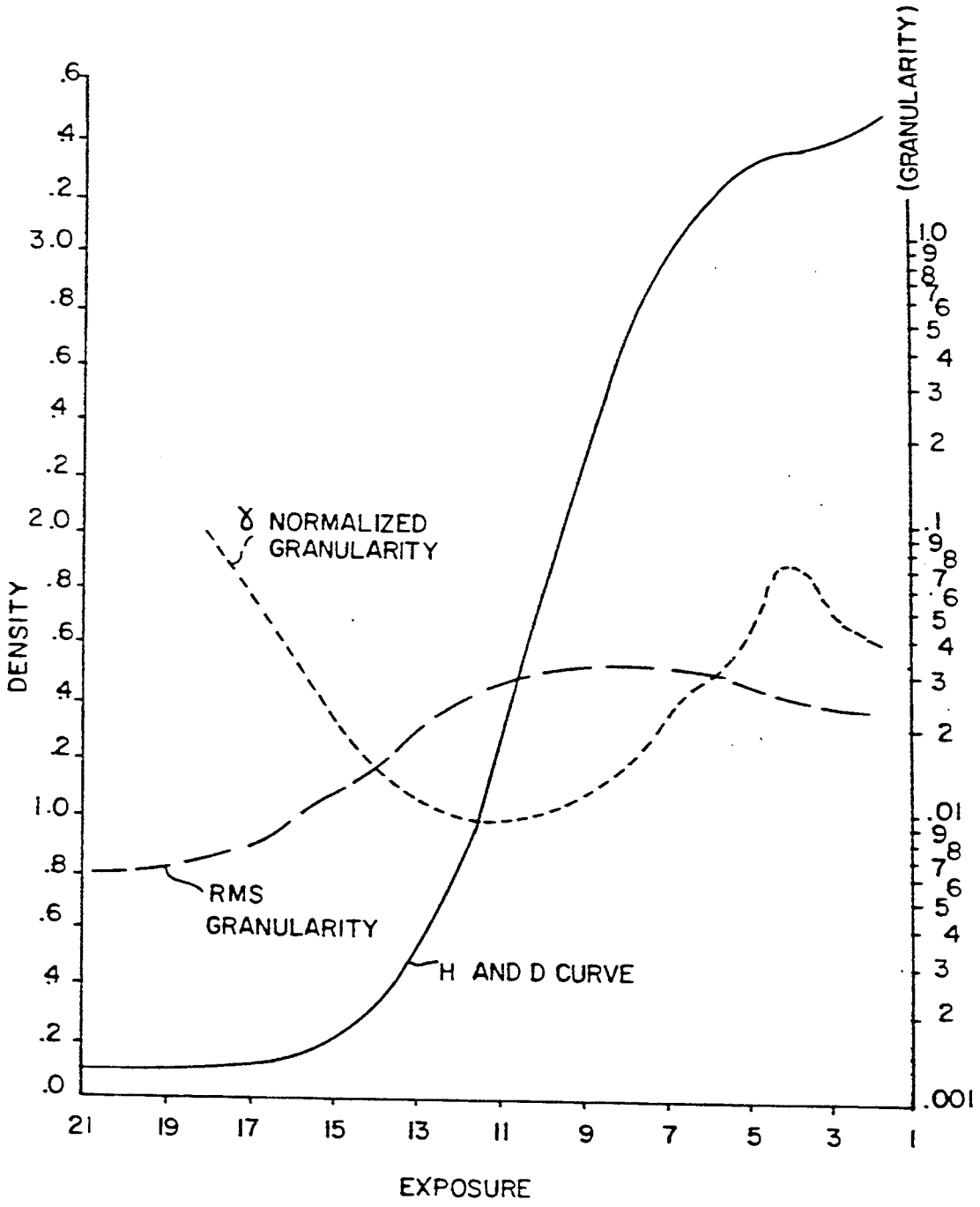
FIGS. 3, 4, and 5 are sensitometric curves of Examples 3 and 4 respectively, with FIG. 5 being combined plot of Examples 3 and 4.
Figure 4:
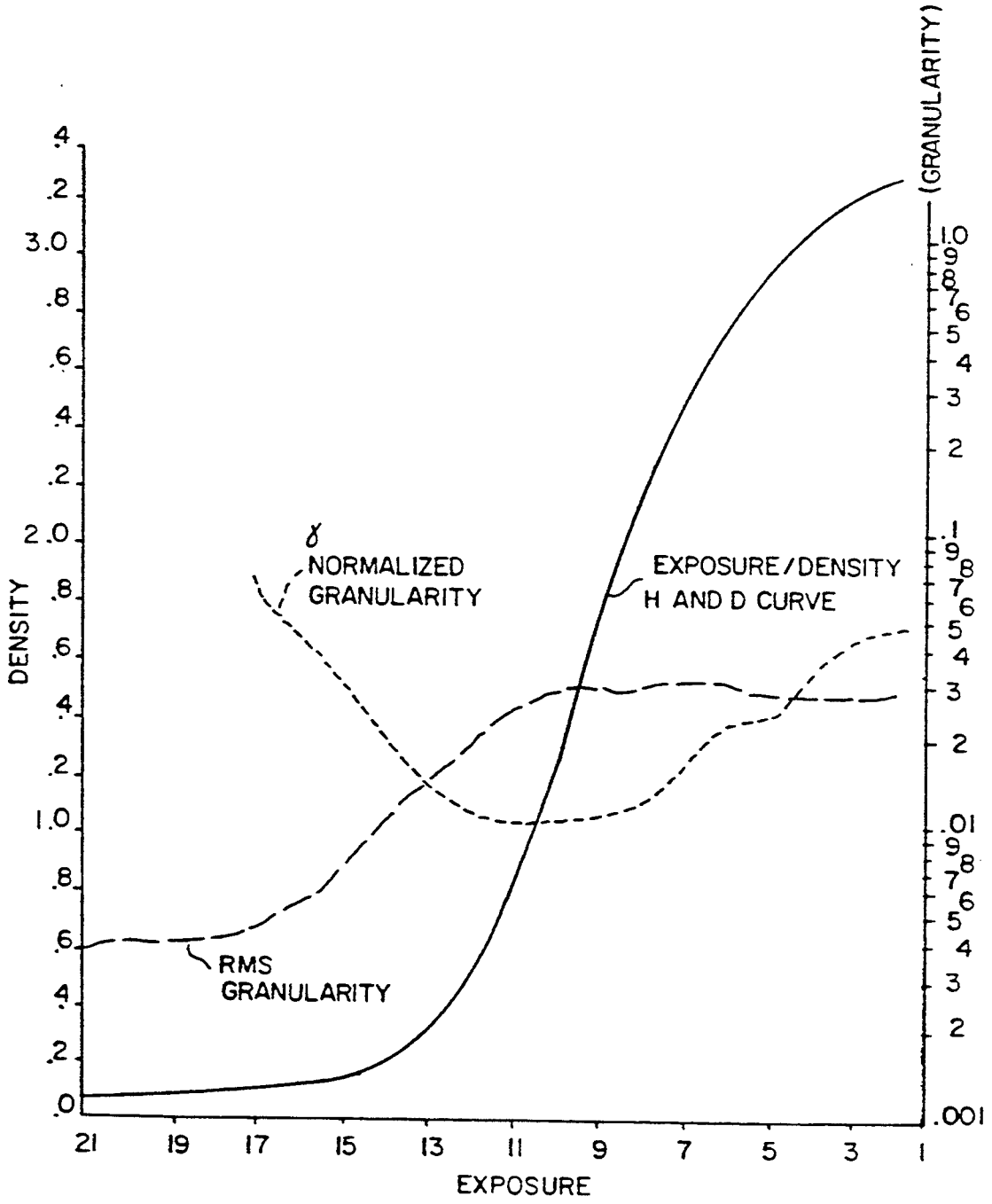
Figure 5:
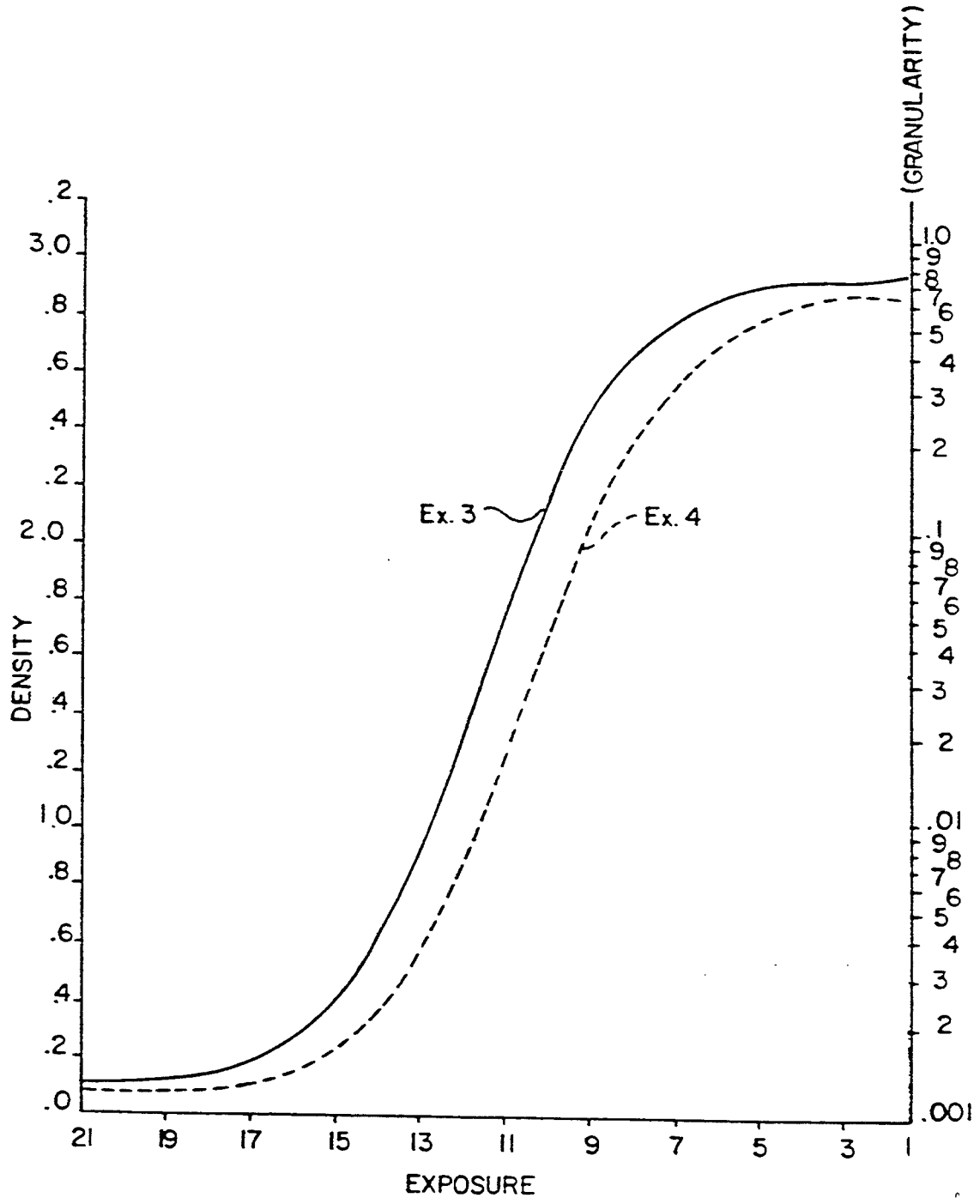

The photographic response of the sensitized emulsion of Example 3, when exposed for 1/50 seconds through a Wratten-9 spectral filter and processed for 3.25 minutes in the C-41 process, displays a clear speed advantage of 0.13 LogE (while giving the same gamma normalized granularity) over the sensitized control Example 4, under the same exposure and processing conditions. This is shown in FIG. 3 for Example 3 and FIG. 4 for Example 4, with the speed advantage more obviously seen in the combined plot of FIG. 5.

Example 5 (Control)

The purpose of this example is to demonstrate that at sufficiently small values of grain diameter the benefits of the invention described above do not appear.

This example describes a procedure which gives a final grain dimension of 0.42 micrometers (number-weighted equivalent circular diameter) by 0.06 micrometers in thickness. Both values were measured by sizing SEM micrographs on a graphics pad. The double parallel twin-plane separation was 0.007 micrometers as measured by the sectioning technique described. The halide composition of these tabular grains was the same as in Example 3—nominally 3 mole percent iodide and 97 mole percent bromide, uniformly distributed in the grain except for a very small (ca. 1% of total silver) portion of 6 mole % I- and 94 mole % Br- reactant addition during nucleation. Like Example 3, this differs from Example 1 mainly in employing (i) a constant 60° C. temperature, (ii) a larger volume initial solution at nucleation, and (iii) unmatched halide and $AgNO_3$ nucleation reactants. This further varies from Example 3 in having a larger volume of nucleation reagents and not requiring removal of a certain fraction of the vessel contents during growth simply due to vessel capacity constraints. More specific details of the precipitation conditions are given in the following paragraph.

Aqueous solutions of 50 mL of 1.80M $AgNO_3$ and 50 mL of 2.57M NaBr $_{0.94}I_{0.06}$ are added together at 100 mL/min into a vessel containing 12.5 liters of solution at 60° C. which consists of 40.0 g $H_2O_2$-oxidized gelatin (with excess peroxide scavenged), 147 mL of 2N $H_2SO_4$ (pH=>1.8), 0.045 moles NaBr, and 0.7 mL of Nalco 2341 antifoamant, plus distilled water to bring the total volume to 12,500 mL. For the next 12 minutes no additional $AgNO_3$ is added to the vessel but gel concentration, pH and pBr are all adjusted. First 100 g additional oxidized gelatin (in 500 mL D.W. at 60° C.) is introduced, followed by a upward pH adjustment to 5.86, and adjustment of the pBr to 1.7 with 1N NaBr. Subsequent to this transition step, growth is carried out by double-jet addition of a total of 1.305 liters of 2.30N $AgNO_3$ and also 2.4N NaBr, with a 3rd jet (coupled to the $AgNO_3$ delivery rate) running in a dilute (0.067M emulsion of AgI (ca 0.1 mm esd grains) for an overall 3m% I- final grain composition. This growth stage is performed at 60° C. and with the pBr maintained at 1.7 until 53% of the total molar amount of Ag (from all sources) has been added. The pBr is then shifted up to 3.3 (by interrupting the halide solution delivery) and the remainder of the growth occurs under these conditions. The reactant addition rates for this growth stage are linearly increased from 33 mL/min to 73 mL/min. The emulsion is washed by ultra-filtration and finally adjusted to 3.4 pBr at 40° C.

Sensitization results of this emulsion follow the description of the comparison tabular grain emulsion of Example 6.

Example 6 (Control)

This example represents the conventional "control" emulsion which shares common external dimensions and iodide content as that formed in Example 5, but the emulsion resulting from the procedure described below will have a larger mean value of twin-plane separation (0.012μ) than that of Example 5. However at this grain diameter, the photographic performance of a narrow twin-plane separation case (Example 5) is not improved over this wide twin-plane separation version as judged by the sensitization and sensitometric responses given in the section following the preparation paragraph. The procedure given here will yield a nominally uniformly distributed 3 mole %-I silver bromoiodide grain (neglecting a small pure AgBr nucleation portion) with final dimensions of 0.40 micrometers (number-weighted equivalent circular diameter) by 0.060 micrometers in thickness as determined by sizing SEM micrographics using a SUMMA graphics tablet. This precipitation is patterned after Example 2 being (i) high-temperature in nucleation, involving a gelatin solution dump but not using oxidized gelatin and undergoing a late-stage shift to high pBr for final growth. The specific conditions are supplied below.

The reaction vessel is charged with 4 liters of solution which contains 12.0 g of non-oxidized non-deionized lime-processed bone gelatin, 0.272 moles NaBr, 0.7 mL of antifoamant (Nalco 2341), and D.W. to bring the total volume to 4000 mL. This solution is heated to 65° C. and by double-jet addition, aqueous solutions of 70 mL of 2.5M $AgNO_3$ and 70 mL of NaBr are added together at 35 mL/minute. The pH is 5.80 and the pBr equals 1.3 (at 65° C.) at the start of this nucleation. During a two-minute period in which the $AgNO_3$ and salt flows are stopped, a 2.5 liter aqueous solution containing 70 g additional gelatin is rapidly added and the reaction vessel temperature is lowered to 55° C. This results in an upward shift in pBr and for most of the remainder of the precipitation the pBr is maintained at 1.7 as growth is carried out by addition of 2.5M NaBr $_{0.97}I_{0.03}$ and 2.5M $AgNO_3$ at a linearly increasing flow rate of 8 mL/min to 30 mL/min over 18 minutes. At end of this segment which corresponds to 79% of the total 1.305 moles Ag in the precipitation, the pBr is shifted up to 2.3 (by temporarily stopping the halide solution delivery) and the rest of the growth occurs under these conditions and using a constant reactant flow rate of 30 mL/minute. The emulsion is washed by ultrafiltration and then adjusted to 3.4 at 40° C.

Sensitization and Sensitometric Comparison of Emulsions of Examples 5 and 6

The reasonably well size-matched pair of emulsions of Examples 5 and 6 were given identical green sensitizations with the dyes I and II previously described. The rationale for choosing the same finishing conditions was based, as before, on expected equal surface area of the size-matched emulsion pair. The following sensitizer reagent levels were employed (on a Ag mole basis):

(i) 250 mg NaSCN
(ii) 0.83 millimole DYE I
(iii) 0.28 millimole DYE II (both dyes added at 1.4 pBr)
(iv) adjust pBr to 3.1
(v) 24 mg $Na_2S_2O_3 \cdot 5H_2O$
(vi) 12 mg $KAuCl_4$
(vii) digest 5 minutes at 65° C.

The sensitized emulsions were coated in the same color negative film format as described previously for Examples 1 and 2 involving 25 mg/ft$^2$ silver and 60 mg/ft$^2$ of magenta coupler A.

Figure 6:
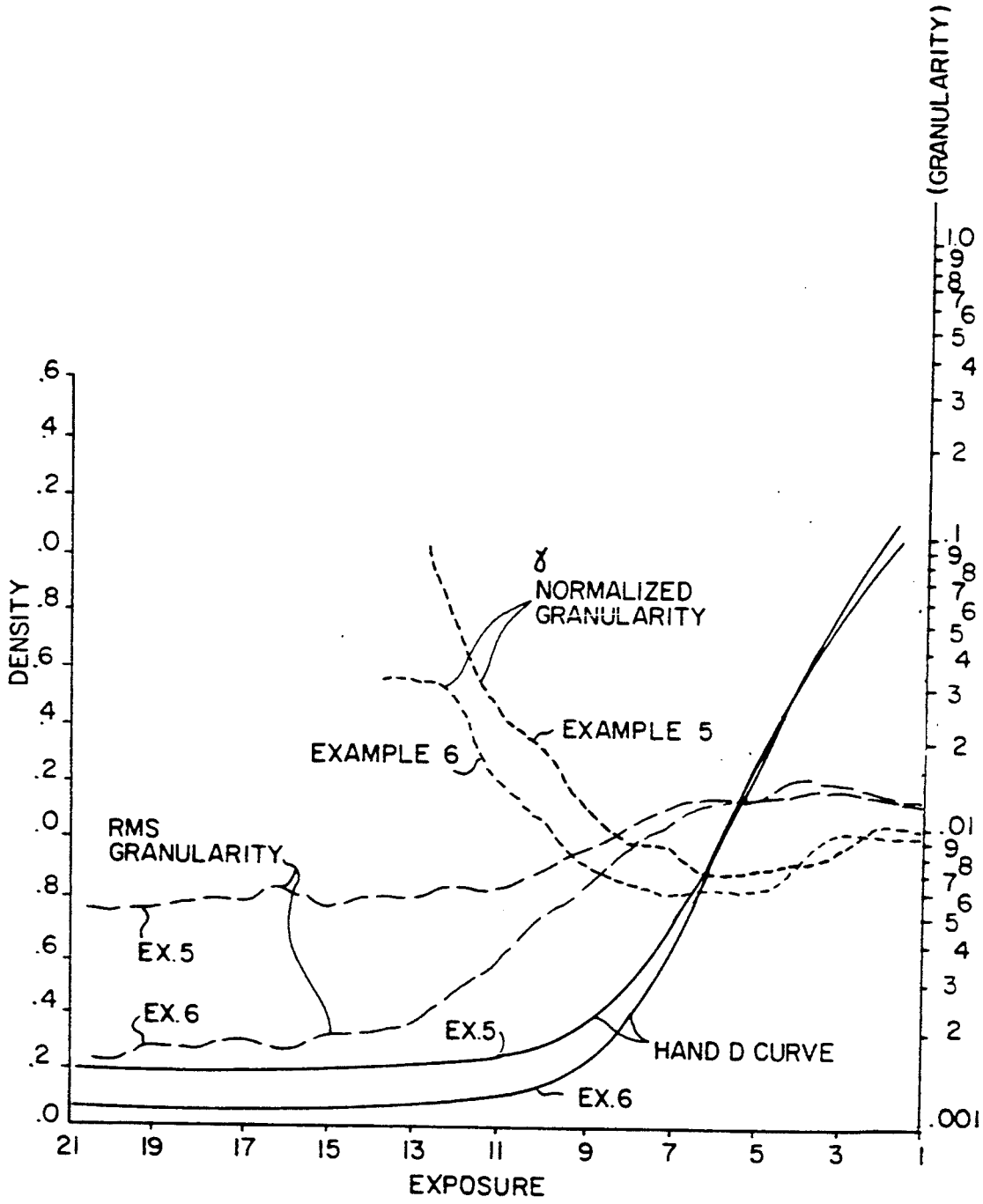
FIG. 6 illustrates the sensitometric responses of coatings containing the sensitized emulsion of Examples 5 and 6.

The sensitometric responses of a ctg containing the green sensitized emulsion of Example 5 and the equivalent ctg of the sensitized emulsion of Example 6 are shown in FIG. 6. A 1/50 sec exposure through a Wratten-9 spectral filter was used along with development of 3.5 minutes in the C-41 color process.

There is no apparent photographic advantage to the emulsion having the narrower twin-plane separation and equivalent circular diameter of less than 0.6 microns. Instead it shows virtually the same speed but with a deficit in granularity of 3 grain units at the minimum of the gamma normalized granularity curves.

Table 1 below is a comparison of the Examples and clearly shows that for the invention the small twin plane separation (up to 0.012 microns) and large size (ECD (greater than 0.6) produces improved results.

TABLE 1

| Example | ECD (Micron) | Thickness (Microns) | (Microns) TP Separation | Photography Response |
|---|---|---|---|---|
| 1 | 0.76 | 0.11 | 0.011 | Ex. 1 better speed/Grain Response than Example 2 |
| 2 | 0.76 (control) | 0.11 | 0.015 | |
| 3 | 0.67 | 0.12 | 0.007 | Example 3 has better speed at same grain as Example 4 |
| 4 | 0.68 (control) | 0.10 | 0.012 | |
| 5 | 0.42 (control) | 0.06 | 0.007 | Shows small grain size & small TP Separation not an advantage |
| 6 | 0.40 (control) | 0.06 | 0.012 | Shows small grain size & wide TP no advantage |

The invention has been described in detail with particular reference to preferred embodiments thereof, but it will be understood that variations and modifications can be effected within the spirit and scope of the invention.

We claim:

1. A tabular-grain silver halide emulsion in which at least 50 percent of the total grain projected area is accosted for by tabular grains having a mean diameter of at least 0.6 micrometer and a spacing between two parallel twin planes of less than 0.012 micrometer wherein said tabular silver halide grains of said emulsion comprise greater than 90 percent of the total number of grains in said emulsion.

2. A tabular-grain emulsion according to claim 1 in which at least 70 percent of the total grain projected area is accounted for by tabular grains having a mean diameter of at least 0.6 micrometer and a spacing between at least two parallel twin planes of less than 0.012 micrometer.

3. A tabular-grain emulsion according to claim 2 in which at least 90 percent of the total grain projected area is accounted for by tabular grains having a mean diameter of at least 0.6 micrometer and a spacing between at least two parallel twin planes of less than 0.012 micrometer.

4. A tabular-grain emulsion according to claim 3 in which said spacing between twin planes is less than 0.011 micrometer.

5. A tabular-grain emulsion according to claim 1 in which said spacing between twin planes is less than 0.011 micrometer.

6. A tabular-grain emulsion according to claim 1 in which at least 50 percent of the total grain projected area is accounted for by tabular grains having a mean diameter in the range of from 1.0 to 10.0 micrometer.

7. A tabular-grain emulsion according to claim 1 in which greater than 50 percent of the total grain projected area is accounted for by tabular grains satisfying the relationship:

$$ECD/t^2>25$$

where

ECD is the mean effective circular diameter in micrometer of the tabular grains and t is the mean thickness in micrometer of the tabular grains.

8. A tabular-grain emulsion according to claim 7 in which greater than 50 percent of the total grain projected area is accounted for by tabular grains satisfying the relationship:

$$ECD/t^2>40$$

where

ECD is the mean effective circular diameter in micrometer of the tabular grains and t is the mean thickness in micrometer of the tabular grains.

9. A tabular-grain emulsion according to claim 1 in which said tabular grains forming greater than 50 percent of the total grain projected area are silver bromide grains optionally including iodide.

10. A tabular-grain emulsion according to claim 9 in which said tabular grains are silver bromide grains.

11. A tabular-grain emulsion according to claim 9 in which iodide accounts for less than 40 mole percent of the total halide forming said tabular grains.

12. A tabular-grain emulsion according to claim 11 in which iodide accounts for 0.1 to 25 mole percent of the total halide forming said tabular grains.

13. A tabular-grain emulsion according to claim 12 in which iodide accounts for from 1 to 15 mole percent of the total halide forming said tabular grains.

14. A tabular-grain emulsion according to claim 1 in which said tabular grains forming greater than 50 percent of the total grain projected area are bounded by parallel major faces lying in {111} crystallographic planes.

15. A tabular-grain emulsion according to claim 1 which includes a grain-dispersing medium comprised of a gelatino-peptizer.

16. The emulsion of claim 1 wherein said halide of said silver halide comprises bromide.

17. The emulsion of claim 16 wherein said emulsion further comprises iodide.

18. The emulsion of claim 1 wherein said tabular grains are greater than 0.11 micron thick.

19. A photographic element comprised of a film support and, coated on the support, a tabular-grain silver bromoiodide emulsion in which at least 50 percent of the total grain projected area is accounted for by tabular silver bromoiodide grains containing less than 10 mole percent iodide, based on total halide, having a mean diameter of at least 0.6 micrometer and exhibiting a spacing between at least two parallel twin planes of less than about 0.11 micrometer and wherein said tabular silver bromoiodide grains in said emulsion comprise greater than 90 percent of the number of grains in said emulsion.

20. The emulsion of claim 19 wherein said tabular grains are greater than 0.11 micron in overall thickness.

* * * * *

UNITED STATES PATENT AND TRADEMARK OFFICE

CERTIFICATE OF CORRECTION

PATENT NO. : 5,334,495
DATED : August 2, 1994
INVENTOR(S) : Donald L. Black, et. al.

It is certified that error appears in the above-indentified patent and that said Letters Patent is hereby corrected as shown below:

Column 15, lines 5-6, "ac-costed" should read --ac-counted--.

Signed and Sealed this

Twenty-fourth Day of January, 1995

*Attest:*

Bruce Lehman

BRUCE LEHMAN

*Attesting Officer*

*Commissioner of Patents and Trademarks*